United States Patent [19]

Appling

[11] Patent Number: 4,795,108

[45] Date of Patent: Jan. 3, 1989

[54] LEVEL WIND SYSTEM

[75] Inventor: James Appling, Canoga Park, Calif.

[73] Assignee: Allied-Signal Inc., Morristown, N.J.

[21] Appl. No.: 97,991

[22] Filed: Sep. 17, 1987

[51] Int. Cl.[4] ..... B65H 57/28

[52] U.S. Cl. ..... 242/157.1

[58] Field of Search ..... 242/157.1, 158 R, 158.2, 242/157 R, 117, 158.4 A

[56] References Cited

U.S. PATENT DOCUMENTS

| | | | |
|---|---|---|---|
| 2,452,297 | 10/1948 | Gaye | 242/158 R |
| 2,599,926 | 6/1952 | Le Bus | 242/117 |
| 2,620,996 | 12/1952 | Le Bus | 242/117 |
| 2,708,080 | 5/1955 | Le Bus, Sr. | 242/117 |
| 2,757,883 | 8/1956 | Schlang et al. | 242/158.4 A |
| 2,926,001 | 2/1960 | Mack et al. | 242/157 R X |
| 3,248,088 | 4/1966 | Benson et al. | 242/157.1 |
| 3,589,643 | 6/1971 | Takizawa | 242/158.2 |
| 3,966,171 | 6/1976 | Hale | 242/157.1 X |
| 4,015,798 | 4/1977 | Benya | 242/157.1 |
| 4,057,202 | 11/1977 | Carr, Jr. | 242/157.1 X |
| 4,310,126 | 1/1982 | Norleen | 242/157.1 X |
| 4,381,852 | 5/1983 | Ferree et al. | 242/157.1 X |
| 4,515,329 | 5/1985 | Sandvik | 242/157.1 |

FOREIGN PATENT DOCUMENTS

| | | | |
|---|---|---|---|
| 239809 | 1/1961 | Australia | 242/157.1 |
| 993133 | 7/1951 | France | 242/157.1 |
| 1330280 | 5/1963 | France | 242/157.1 |
| 140458 | 11/1980 | Japan | 242/157.1 |
| 145968 | 11/1980 | Japan | 242/157.1 |
| 261465 | 8/1949 | Switzerland | 242/157.1 |

*Primary Examiner*—Stanley N. Gilreath

*Attorney, Agent, or Firm*—Robert C. Smith

[57] ABSTRACT

A level wind system suitable for winding an elongated sonar array onto and off from a storage drum includes a guide member which guides the array into a counterbalanced free pivoting arm having a large radius arcuate section terminating substantially in tangential relationship to said drum and which uses the tension force on the array to continually reposition itself relative to each previous wrap on the drum. A series of rollers are located on the inside surface of the arm to guide the array and to minimize the forces on the array. A pair of spring-loaded rollers are positioned between the storage drum flanges which hold the array in position and prevent slack from developing during power-off situations.

4 Claims, 1 Drawing Sheet

LEVEL WIND SYSTEM

Figure 1:
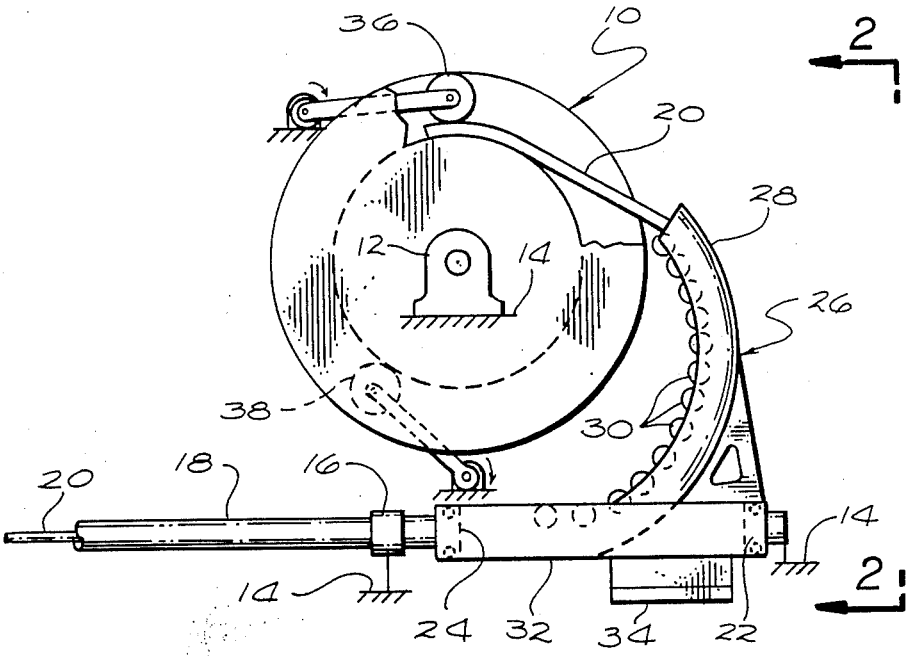

This invention relates to a level wind system and more particularly to a level wind system suitable for winding an elongated sonar array onto a storage reel for maximum utilization of the space available.

There are a number of well-known devices for effecting level winding of a cable, a fishing line or a rope onto a reel. One such device is the Acme screw-driven pulley which directs the cable or wire onto a storage drum. A disadvantage of this device is that the pulleys required may have to be quite large to meet the minimum bend radius of the cable. Another approach is mechanically positioning of the storage reel a considerable distance from the point of cable feed which will allow a natural level wind without any mechanism. This fairlead distance is usually in excess of ten times the storage reel width. Such an arrangement is usually not practial for shipboard installations. Another approach has been manual positioning of the cable with a lever or handwheel device to align the cable with the storage drum. This is, in general, not practical for most applications for shipboard installation. A somewhat more recent development is the Lebus levelwind counterbalanced pulley with an eccentric shaft. A large pulley is required and this system will operate only in the horizontal position. A loss of tension causes erratic wrapping of the cable.

Certain level wind devices are discussed below. Lowery, U.S. Pat. No. 3,514,048, shows a cable feed device in which the entire frame is held stationary and the flexibility to follow the cable being reeled in is afforded by a flexible tube attached to the frame. There is no pivot structure.

Hara et al, U.S. Pat. No. 3,833,184, shows a device for guiding a "linear product" on a reel including a pivot arm. The arm actually comes in touch with the drum portion of the reel and holds the cable to the drum. No tensioning rollers are used. Other level wind systems are shown in U.S. Pat. Nos. 3,589,641; 2,336,684 and 4,057,202.

An elongated sonar array is like a hose of significant diameter containing a number of internal electronic parts and hydrophones. As compared with normal winding onto a drum of a cable, wire rope or other rope, winding onto a drum of such a sonar array requires a minimum acceptable bend radius which is quite large. This limits the use of feed pulleys or sheaves for this application or requires correspondingly large sheaves. In addition, the present application requires a very short distance between the storage drum and the point at which the cable is fed onto the drum or the fairlead distance. Given a short fairlead distance and a comparatively wide drum, it becomes quite difficult to effect the desired uniformity of wraps. Also, the feed arrangement must be such that the array is not subject to damaging forces as by crushing. Thus many of the prior art devices prove unsatisfactory for the application discussed herein because of the extremely short fairlead distance, because of the need to avoid pulling the array into too small a bend radius, and because of the need to avoid excessive crushing forces which might be imposed from wedging the array against the drum flanges or from stacking multiple layers of the array on the drum.

Applicant has provided a system which overcomes the above deficiencies by the use of a free-pivoting arm having an arcuate section terminating substantially in tangential relationship to the drum and which repositions itself relative to each wrap of the array previously wrapped on the drum. The ability to achieve this repositioning is due to the mechanical advantage at the end of the free-pivoting counterbalanced liner arm in conjunction with the array tension which tends to impart a lateral movement of the arm to align this end point with the previous array wrap on the storage drum. Array tension between the storage drum and the pivoting arm becomes an important feature which is required toward providing a uniform wrap.

A minimum of two rollers are positioned between the storage drum flanges to hold the array wrapped on the drum in position. The rollers are spring-loaded to provide sufficient force to the array to prevent array slack during "power-off" situations which could cause non-uniform wrapping.

It has been found that the system will provide more uniform wraps of the array on the storage drum when used with a "Lebus Liner" or grooved liner attached to or formed on the storage drum. While the Lebus Liner is not considered an essential part of the invention, it would probably be used in most applications to enhance performance.

Applicant's level winding device can be installed in a smaller space than other known level winding devices which are capable of handling an array of the desired type, length and diameter. When properly sized and with sufficient array tension, it can operate with the storage reel mounted in either a vertical or horizontal position.

Figure 2:
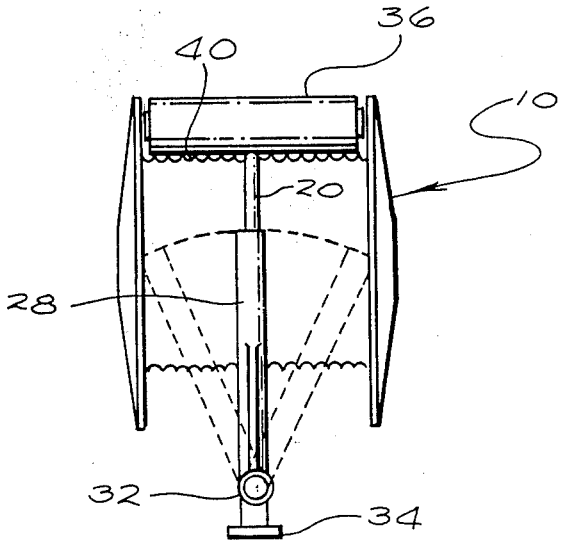

In the drawings:

FIG. 1 is a side view, with portions broken away, of a level wind system according to my invention; and FIG. 2 is a view along line 2—2 of the level wind system of FIG. 1.

Referring now to FIG. 1:

A storage drum 10 is shown driven by a suitable motor 12 mounted on an appropriate base 14. Mounted on the base 14 is a sleeve 16 which supports one end of a guide tube 18 through which an elongated tubular sonar array is fed. Also supported on base 14 is a bearing 22 which cooperates with an additional bearing 24 carried on the guide tube 16. A pivot arm assembly 26 includes an arcuate arm member 28 which is hollow or channel-shaped and which carries a series of roller members 30 on its interior curved surface or edges. Also forming part of the pivot arm assembly is a tubular support member 32 to which is attached a counterweight 34. The array 20 is fed through the guide tube 18 into the tubular support member 32 and up through the arcuate arm 28 where it passes over the rollers 30 before being directed onto the storage drum 10. Also attached to base 14 or other suitable base members are a pair of spring-loaded rollers 36 and 38 which are positioned between the storage drum flanges to hold the array wrapped on the drum in position. These rollers are spring loaded to apply sufficient force to the wrapped array to prevent slack which could cause non-uniform wrapping during "power-off" situations.

FIG. 2 is a view taken along line 2—2 of the level wind system of FIG. 1. It thus views the level wind structure from the end showing the edges of the flanges of drum 10 and the cylindrical portion including a "Lebus Liner" 40 which, although not necessarily always required, is desirable to insure the start of a proper lay of the tubular array 20.

Considering the operation of the system, it will be first assumed that the motor 12 is rotating the drum 10 such that the array 20 is being wound onto the drum. As the array is fed through guide tube 18 and the pivot arm assembly 26, this assembly is free to rotate on the bearings 22, 24, thereby moving across an arc between the flanges of drum 10 as shown in FIG. 2. As each layer is wound on the drum the free-pivoting arm 28 moves in response to the tension on the array which imparts a lateral movement of the arm to align its end point with the previous cable wrap on the drum. In this manner, the pivot arm 28 will move in an arc across the width of the drum directing each wrap adjacent the one previously laid. When the first layer is completed, the surface of this layer provides a natural track for the positioning of subsequent layers so that each layer is neatly deposited on top of the one below.

Friction and wear on the array is minimized through the use of the rollers 30 which tend to keep the array moving smoothly onto or off of the drum. It will be recognized that the arm 28 is comparatively large and, preferably, does not impose a bend radius on the array which is substantially smaller or tighter than that of the drum itself. As the pivot arm 28 moves back and forth its weight and the weight of the enclosed array portion are, in effect, balanced by the counterweight 34 which thus substantially reduces or eliminates the resistance which might be felt on the cable were the pivot arm assembly not so counterbalanced. As each wrap is laid on the drum it comes under the pressure of one of the roller assemblies 36, 38 which, without exerting an excessive force, tend to hold the wraps in position on the drum. In the event of loss of power, the drum would cease to rotate but the wraps will be held in position by the rollers 36, 38.

When the motor 12 is reversed to drive the array 20 off the drum 10, the array again passes through the pivot arm 28 and over rollers 30 before passing through the guide tube 18 and into the water. The pivot arm 28 will freely move as required to align itself with each wrap as it leaves the drum and passes over rollers 30. Thus damage and wear on the array is slight in the deployment of the array, any lateral forces theron being minimized by the freely pivoting arm assembly 26.

From the foregoing, it will be appreciated that the structure described herein provides a means of driving an elongated sonar array onto and off of a storage drum in such a way that the array is neatly wound on the drum for maximum utilization of the space. The pivot arm assembly provides a way of making a compact wrap without requiring extra pulleys or sheaves and, in fact, provides the function of a large fairlead sheave which would have a diameter substantially as large as that of the drum itself. Yet such a fairlead sheave would necessarily require a much longer fairlead distance because of its diameter. Thus it will be seen that the level wind system described herein provides a way of winding a comparatively large diameter and somewhat fragile elongated sonar array onto and off of a storage drum without subjecting the array to tight radius bends, excessive longitudinal forces or heavy crushing forces. The structure is quite simple in that it makes use of the array tension to align each wrap adjacent to the previous wrap. And because of its compact dimensions, the level wind system described herein is particularly useful for towed arrays which are carried on shipboard.

What is claimed is:

1. A level wind system for winding multiple layers of an elongated acoustic array on and off a drum in an orderly manner such that space available on said drum is utilized to the maximum extent and the forces applied are not such as to damage the array, said system comprising a drum of sufficient radius that said array is not subjected to excessive bending stresses when wound on said drum and achored to a suitable base and means driving said drum around its axis, a roller assembly fastened to said base and spring loaded to exert force against said layers on said drum, and a hollow free pivoting counterbalanced arm including an arcuate section having a bend radius not substantially smaller than that of said drum terminating substantially in tangential relationship to said drum having a plurality of rollers attached to its interior curved surface such that said array is directed over said rollers as it is wound on or off said drum, a stationary guide tube located along the axis of said counterbalanced arm for directing said array into said arm, said counterbalanced arm pivoting on bearings around an axis in a plane normal to the axis of said drum and responding to array tension to constantly reposition said arm to align its end point with the previous wrap on said drum.

2. A level wind system as claimed in claim 1 wherein the surface of said drum includes guide grooves for the first layer of said array.

3. A level wind system as claimed in claim 1 wherein a plurality of said roller assemblies are provided, said roller assemblies being positioned such that at least two of said assemblies apply pressure to said layers at positions separated by at least one fourth of the circumference of said drum.

4. Level wind system as claimed in claim 1 wherein one of said bearings is positioned between said arm and an end of said guide tube and another of said bearings is suppported on said base.

* * * * *